United States Patent [19]

Shook et al.

[11] Patent Number: 4,736,805

[45] Date of Patent: Apr. 12, 1988

[54] HYDRAULIC BREAKER WITH HIGH PRESSURE WATER ATTACHMENT

[75] Inventors: Forrest A. Shook, Fenton; Gerard J. DeSantis, Battle Creek, both of Mich.

[73] Assignee: NLB Corp., Wixom, Mich.

[21] Appl. No.: 887,459

[22] Filed: Jul. 21, 1986

[51] Int. Cl.[4] ..... E21B 10/38

[52] U.S. Cl. ..... 173/78; 175/422 R

[58] Field of Search ..... 173/73, 78, 80; 30/123.3; 175/67, 414, 422 R; 299/17, 81; 405/248, 236

[56] References Cited

U.S. PATENT DOCUMENTS

| | | | |
|---|---|---|---|
| 888,497 | 5/1908 | Hellman et al. | 173/80 |
| 904,692 | 11/1908 | Greve et al. | 173/80 |
| 1,868,684 | 7/1932 | Bayles | 173/78 |
| 2,051,053 | 8/1936 | Morris | 173/78 |
| 4,049,318 | 9/1977 | Fruin | 299/81 |
| 4,534,427 | 8/1985 | Wang et al. | 175/67 |
| 4,610,321 | 9/1986 | Whaling | 175/422 R |

OTHER PUBLICATIONS

Brochure, "The Teledyne Roxon Hydraulic Breaker System" (Dec. 1982) by Teledyne Canada Mining Products.

*Primary Examiner*—E. R. Kazenske
*Assistant Examiner*—Hien H. Phan
*Attorney, Agent, or Firm*—Cullen, Sloman, Cantor, Grauer, Scott & Rutherford

[57] ABSTRACT

A tool for a hydraulic breaker having a pressurized fluid system which coacts with the impact tool to break objects such as rocks or aggregate sections. The impact tool has a bore extending through a work engaging end. A conduit is routed into the bore and includes a nozzle at its terminal end adjacent the work engaging end of the tool through which high pressure water is directed at the object to be broken. The tubing extends through the sidewall of the tool and into the bore through a radially extending slot. The tubing is mounted on the housing of the hydraulic hammer by means of an elastomeric vibration-dampening mounting block. The tubing is connected by high pressure hose to a valve and pump capable of developing fluid pressure in the range of about 20,000 psi. The slot is elongated to permit indexing of the tool relative to the hammer. The tool is retained in the hammer by means of a tool retainer or socket. A method of breaking an object is also disclosed using the above apparatus wherein the shock imparted to the object to be broken and pressurized fluid stream coact to propagate fissures formed in the object as a result of the shocks and cause the object to break.

12 Claims, 1 Drawing Sheet

HYDRAULIC BREAKER WITH HIGH PRESSURE WATER ATTACHMENT

BACKGROUND OF THE INVENTION

The present invention relates to an impact tool for a power driven impact hammer which is used to break hard objects such as rocks. The impact tool includes a high pressure water blasting system for directing pressurized fluid upon the object to be broken which cooperates with the impact tool in breaking up the object.

Impact tools are used in mining, quarrying, construction and demolition work to break apart hard objects such as large stones and blocks of aggregate. Impact tools are used in conjunction with hydraulic hammers that may be secured to an excavator boom. The hydraulic hammers include a piston which repeatedly exerts an impact, or shock, upon and through the impact tool. The impact tool is normally retained in a socket, or tool holder, which comprises part of the hammer.

Impact tools used in such hydraulic hammers are normally solid, blunt or pointed chisel tools made from tool steel. The impact tools are known to range from three to six inches in diameter and are designed to withstand impacts in the range of 500 to 5000 foot pounds. In operation, the impact tools are generally positioned against the object to be broken and the hydraulic hammer exerts an impact force upon the opposite end of the impact tool.

Impact tools are subject to wear and require replacement after several hundred hours of operation. The working end of the impact tool can become severely deformed over time. Impact tools are expensive and efforts have been made at extending tool life. Such tools are known to deliver from 250 to 1300 blows per minute. Even though the impact tools are made of tool steel, continued repetition of the impact leads to deformation of the tools.

One objective of impact tools is the extension of tool life. Another objective of such tools is the improvement of productivity and faster object breakage.

In mining and other environments where flammable gases are a potential problem, it is important to minimize the possibility that a spark will be created by the impact tool.

Another problem is caused by the build-up of heat in the impact tool as a result of the repeated impacts applied through the tool. When a tool is hot, it is more readily deformed.

These objectives are achieved and problems are solved by the present invention as summarized below.

SUMMARY OF THE INVENTION

According to the present invention, an impact tool used with a power-driven impact hammer is disclosed wherein a nozzle is disposed in a bore formed in the impact tool which directs a stream of fluid toward an object to be broken. The impact tool has an elongated body with a shank portion which is received in tool receiving socket formed in the hammer head. The body of the impact tool includes a work engaging end at the opposite axial end of the body from the shank portion. The work engaging end has a bore extending axially in the body from the work engaging end toward the shank portion. A conduit in fluid communication with a source of pressurized fluid extends from outside the impact tool into the bore. The fluid conduit is fitted to the nozzle to direct a stream of fluid axially through the work engaging end to apply a fluid pressure to an object to be broken. The fluid pressure and impacts delivered by the hammer coact to break apart a rock or other hard object.

The fluid conduit is preferably connected to a portion of the housing of the hydraulic hammer with a shock absorbing mount preferably formed of an elastomeric material.

The fluid conduit extends through a slot in the impact tool which extends from the bore through the wall of the impact tool. The slot is preferably quadrilateral in longitudinal section wherein the slot extends from an axial point in the bore closer to the work engaging end of the impact tool to an axial point at the exterior wall of the tool closer to the shank of the impact tool. In this way, the conduit may be formed in one piece to extend from the shock absorbing mount on the housing of the hammer into the bore in the impact tool with only obliquely angled bends formed in the conduit.

The slot formed in the wall of the tool for the conduit is elongated to permit the impact tool to be indexed inwardly and outwardly from the hydraulic hammer.

The bore in the impact tool is preferably centered within the tool and extends along the axis of the tool to a point intermediate the work engaging end and shank of the impact tool.

The present invention also relates to a method of breaking rocks and other fracturable hard objects by first placing an impact tool on the object to be broken then inducing repeated shocks through the impact tool by means of a hydraulic hammer. Simultaneously, high pressure water is directed perpendicular to the axis of the tool at the portion of the object engaged by the impact tool. The high pressure water is forced under pressure into fissures formed in the object by the impact tool. The pressurized water propagates the fissures and coacts with the repeated impacts from the impact tool to cause the object to burst due to both the repeated impacts and the action of the high pressure water flow.

The present invention accomplishes the objective of improving productivity by reducing the time required to break up rocks and other hard objects. As a result of the greater productivity and reduced time required to break a given object, more objects may be broken within the life of a tool since the tool must transmit fewer impacts per object broken.

Tool life is further extended by the use of the high pressure water spray since the water also doubles as a cooling medium keeping the work engaging end of the tool cool.

The object of minimizing sparking is achieved by the use of a high pressure water spray which reduces friction and extinguishes any sparks immediately.

The process according to the present invention is speeded by the high pressure water. The repeated impacts of the impact tool against the rock send shock waves through the rock and results in the formation of small fissures prior to breakage. When the high pressure water enters the fissures, a hydrostatic pressure is developed within the fissures which helps blow the rock apart. The high pressure water exerts a force upon the walls of the fissures, or cracks, which may extend deeply into the rock. When high pressure water in the range of 20,000 psi is introduced into the fissures, the water fills the voids in the cracks and fissures pressurizing the fissures until the rock is no longer capable of resisting the 20,000 psi pressurized fluid causing the rock to shatter.

These and other objects and advantages realized by the present invention will become more readily apparent upon a review of the attached drawings and following detailed description.

DETAILED DESCRIPTION OF THE PREFERRED EMBODIMENT

Figure 1:
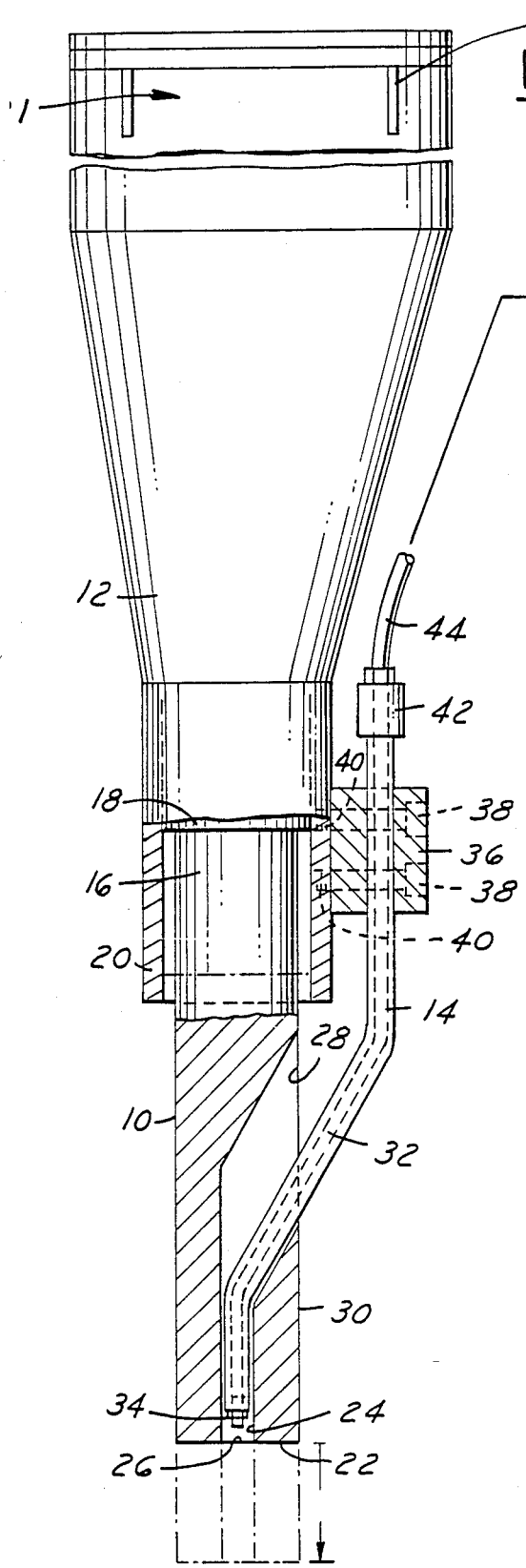
FIG. 1 is a partial cross-sectional view of an impact tool and high pressure water blasting system secured to a hydraulic impact hammer according to the present invention.

Referring now to FIG. 1, the impact tool 10 is shown operatively connected to a hydraulic hammer 12 having a hydraulically powered reciprocating cylinder (not shown). A water blasting system 14 is connected to the impact tool 10 to direct a stream of water therethrough.

The impact tool 10 is a one-piece body having a shank 16 at its uppermost end as viewed in FIG. 1. The shank 16 is received within a tool retainer 18, or socket, of the hydraulic hammer 12. The tool retainer 18 is of a conventional type wherein the shank 16 of the tool 10 is positively locked in place by a locking means and wherein the more or less of the tool shank 16 may be received in the retainer 18 before the tool 10 is locked in place. The tool retainer 18 is disposed within the housing 20 of the hydraulic hammer 12. Motor means 21 is also disposed within the housing 20, in a manner well known to those skilled in the art. The housing 20 is provided with vents 23 for motor 21.

The impact tool 10 has a work engaging end 22 at the lower portion of the tool as viewed in FIG. 1. The work engaging end may be flat or shaped. A central cylindrical bore 24 is formed in the impact tool 10 and extends from the work engaging end 22 to a pont intermediate the work engaging end 22 and the shank 16. The central cylindrical bore 24 is preferably concentric with the central axis of the tool 10. The central cylindrical bore 24 opens through the work engaging end 22 forming an orifice 26.

A radial slot 28 is formed in the tool 10 to extend from the bore 24 through the sidewall 30 of the tool 10. As viewed in FIG. 1, the slot 28 is preferably quadrilateral in cross-section. The slot extends from an axial point in the bore closer to the work engaging end to an axial point in the sidewall 30 closer to the shank.

The pressurized fluid system 14 comprises a length of high pressure tubing 32 which extends from outside of the tool through the radial slot 28 and into the central cylindrical bore 24 where it is capped by a nozzle 34. The nozzle 34 directs a flow of pressurized water through the orifice 26 to impinge upon the object intended to be broken by the tool 10. The nozzle 34 is disposed in the end of the tubing 32 adjacent the work engaging end 22 of the tool 10. The nozzle 34 is located within the central cylindrical bore 24.

The upper end of the tubing 32, as viewed in FIG. 1, is secured to the housing 20 of the hydraulic hammer 12 by means of a vibration dampening tubing mount 36. The tubing mount 36 is secured to the housing 20 by means of fasteners 38 which are preferably received tapped holes 40 formed in the housing 20. The tubing mount 36 is preferably formed of an elastomeric material which is capable of absorbing the vibration caused by the operation of the hydraulic hammer 12 to thereby isolate the tubing from the vibration.

The tubing 32 is connected by means of a fitting 42 to a high pressure hose 44. The high pressure hose 44 is in fluid flow communication with a valve 46 and a pump 48 which is capable of developing pressures in the range of about 20,000 psi. The pump 48 is connected to a fluid reservoir 50 from which the water, or other fluid, may be drawn for supplying the hose 44 and tubing 32 with high pressure water.

Figure 2:
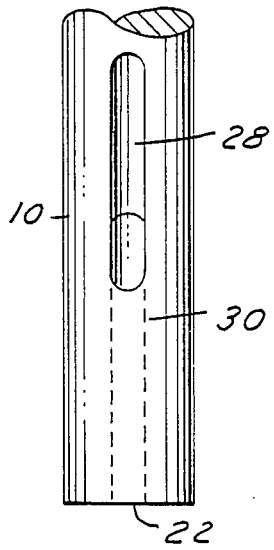
FIG. 2 is a fragmentary side elevational view of the impact tool of the present invention.

Referring now to FIG. 2, the impact tool 10 is shown. The impact tool 10 is specially adapted for use in the present invention wherein the central cylindrical bore 24 is formed in the work engaging end 22 to extend to an intermediate point wherein it is open to the slot 28. The slot 28 extends from the bore 24 through the sidewall 30 of the tool 10.

Figure 3:
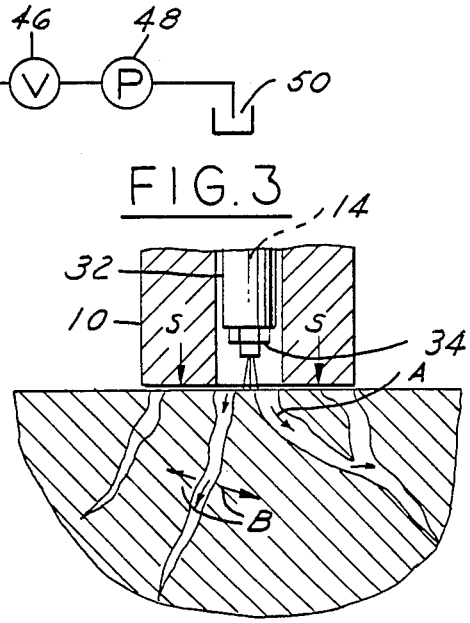
FIG. 3 is a schematic cross-sectional view intended to illustrate the forces exerted upon a hard object by the impact tool and the high pressure water blasting system.

Referring now to FIG. 3, the operation and coaction of the impact tool 10 and the pressurized fluid system 14 are described. While not wishing to be bound by theory, it is believed that the advantageous results of the invention are obtained because of the unique combination of the impact tool 10 and the high pressure fluid system 14. The impact tool exerts upon an object to be broken impacts or shocks designated by the arrows S. Shock waves are sent through the object causing fissures to form in the object. The fissures are formed in the object prior to reaching the point at which the object will split apart by the action of the impact tool alone. When fissures are formed, water from the high pressure fluid system 14 flows from the tubing 32 through the nozzle 34 substantially perpendicularly to the surface of the object. The tool 10 is in engagement with the object to be broken and acts to substantially seal the portion of the object about the nozzle 34 so that the water is directed, as shown by arrows A, into the fissures formed in the object. The water remains under high pressure as it fills the fissures which results in an outward pressure, represented by arrows B upon the walls of the fissures. This causes the fissures to widen and extend deeper into the object. As the fissures widen and deepen, the shocks delivered by the impact tool 10 are continued and the shock waves and high pressure water coact to accelerate the rock breaking process.

Referring to FIG. 1, the dashed lines at the working end 22 illustrate the extent of travel indicated by the arrow T possible with the hydraulic hammer. The hydraulic hammer has a limited degree of travel which permits the tool to be extended or retracted to a limited extent to place it in contact with the object to be broken. It is to be appreciated that, as the tubing is secured to the housing 20, the slot 28 preferably extends longer longitudinally between the axial points proximate the work-engaging end 22 and the shank 16, than the limited degree of travel of the hydraulic hammer, so that more or less of the tool shank 16 may be received in the retainer 18 as has been explained. It should be noted that the tool does not generally reciprocate in operation but instead is placed into contact with the object to be broken. Impacts applied by the hydraulic hammer 12 are transmitted from the shank 16 to the work engaging end 22 through the tool 10.

While the invention has been described with reference to the illustrated embodiment, it should be understood that there are many alternatives, modifications and variations possible within the spirit and scope of the invention. The invention is to be measured solely by reference to the following claims.

We claim:

1. In combination with a power driven impact applying hammer disposed in a housing and having a tool receiving socket, an impact tool having an elongated body with a shank portion on a first end received in the socket and a work engaging end on a second end at the opposite axial end of the body from the shank portion, the work engaging end having a bore extending axially in the body, a fluid conduit in fluid flow communication with a source of pressurized fluid and extending from outside the tool into the bore through a slot formed in the body between the first and second ends and extending from the bore to a sidewall of the body, and a nozzle connected to the fluid conduit and disposed in the bore to direct a stream of fluid axially through the work engaging end wherein fluid pressure is applied through the work engaging end to an object to be broken by the coaction of the impacts applied by the hammer and the fluid pressure.

2. The combination of claim 1 wherein the fluid conduit is connected to the housing of the hammer by a mount formed of a vibration dampening elastomeric material.

3. The combination of claim 1 wherein the slot is quadrilateral in longitudinal section, the slot extending from an axial point at the bore which is closer to the second end than the point at which the slot opens in the sidewall of the body.

4. The combination of claim 3 wherein the tube is formed from a single length of tubing which extends from a mount connected to the housing of the hammer through the slot and into the bore.

5. The combination of claim 1 wherein the impact applying hammer has a limited degree of travel and wherein the slot is elongated in the axial direction to permit the tool to extend to a greater or lesser extent between the housing and the work end without changing the position of the conduit relative to the housing.

6. The combination of claim 1 wherein the bore is centered within the tool and aligned with the central axis of the tool.

7. The combination of claim 6 wherein the tool is cylindrical in shape and said bore is aligned with the axis of the tool.

8. A hydraulic breaker system comprising:

a housing;

motor means disposed in the housing for driving a linearly reciprocable member;

a tool holder operatively connected to the motor means;

an elongate tool having a first end retained in the tool holder, the tool having a working end which is placed in contact with an article to be broken;

a fluid;

pump means for pressurizing the fluid;

a fluid conduit means in fluid flow communication with the pump means;

a nozzle recessed within an opening formed in the tool, the opening extending from the working end axially into the tool, the nozzle having an opening directed toward the working end, the nozzle being connected to the end of the fluid conduit for spraying the fluid at high pressures through the second end of the tool at the point on the object engaged by the working end;

the fluid conduit extending from inside the tool through an elongated opening in a side of the tool between the first end and the working end;

mounting means attached to the housing for securing the conduit to the housing, the mounting means being formed of a vibration-dampening material.

9. The combination of claim 8 wherein the slot is quadrilateral in axial section, the slot extending from an axial point in the bore which is closer to the second end than the point at which the slot opens in the sidewall of the body.

10. The combination of claim 9 wherein the tube is formed from a single length of tubing which extends from a mount connected to the housing of the hammer through the slot and into the bore.

11. The combination of claim 8 wherein the tool is indexable relative to the housing of the hammer to extend to a greater or lesser extent from the housing and wherein the slot is elongated in the axial direction to permit indexing of the tool without changing the position of the conduit relative to the housing.

12. The combination of claim 8 wherein the bore is centered within the tool and aligned with the central axis of the tool.

* * * * *